US006082576A

United States Patent [19]

Counts-Bradley et al.

[11] Patent Number: 6,082,576

[45] Date of Patent: Jul. 4, 2000

[54] SELF-LOCKING, SELF-SEALING INSPECTION PORT

[75] Inventors: Ruby Marie Counts-Bradley, Houston, Tex.; Warren Leeroy Singer, Prairieville, La.

[73] Assignee: Inspection Port Systems, Inc., Prairieville, La.

[21] Appl. No.: 08/744,022

[22] Filed: Nov. 5, 1996

[51] Int. Cl.[7] ..... B65D 39/00

[52] U.S. Cl. ..... 220/787; 220/789; 220/801

[58] Field of Search ..... 220/787, 789, 220/792, 801

[56] References Cited

U.S. PATENT DOCUMENTS

| | | | |
|---|---|---|---|
| 2,737,205 | 3/1956 | Stringfield | 220/801 X |
| 3,133,666 | 5/1964 | Henchert | 220/787 X |
| 3,945,529 | 3/1976 | Haag | 220/789 X |
| 4,202,463 | 5/1980 | Mogler | 220/789 |
| 4,223,800 | 9/1980 | Fishman | 220/801 |
| 4,667,842 | 5/1987 | Collins | 220/789 |
| 5,014,866 | 5/1991 | Moore . | |

*Primary Examiner*—Steven Pollard
*Attorney, Agent, or Firm*—Thomason, Moser & Patterson

[57] ABSTRACT

The present invention is an inspection port that is self-locking and self-sealing when inserted in smooth, embossed, or corrugated metal jackets which contain an insulation layer around process equipment such as reactors, heat exchangers, distillation towers, storage tanks, and pipelines. The inspection port is made from an elastomeric material and includes a tubular body having an outer flange and two locking ridges which are positioned to form a short section for gripping non-corrugated metal and a long section for gripping corrugated metal.

18 Claims, 2 Drawing Sheets

SELF-LOCKING, SELF-SEALING INSPECTION PORT

FIELD OF THE INVENTION

The invention relates to the inspection of insulated objects, more specifically to inspection ports that provide permanent access through a layer of insulation.

BACKGROUND OF THE INVENTION

Periodic inspection of process equipment such as reactors, heat exchangers, distillation towers, storage tanks, and pipelines is typically performed to measure the effects of corrosion or erosion using non-destructive test methods. The inspection process is more difficult for insulated equipment and typically requires numerous inspection ports cut through the insulation material and any metal jacket at locations most susceptible to corrosion and erosion. Depending on the equipment and the insulation material, inspection ports range from open holes in the insulation material and metal jackets to access plates that are fastened over a hole in the metal jacket to contain a removable section of insulation.

U.S. Pat. No. 5,014,866 describes an inspection port which includes an elastomeric, flanged tube and a metal, flanged cap for sealing a hole in a metal jacket containing a layer of insulation around process equipment. The elastomeric tube has a cylindrical body that has a relaxed outside diameter larger than the hole in the metal jacket in order to grip the jacket. The metal cap fits tightly within the elastomeric tube and assists in sealing the tube within the hole in the metal jacket. The tube has a length sufficient to contact the edges of holes through flat or corrugated metals. Both the tube and the cap are flanged to prevent over insertion and the flange of the cap is sized to protect the flange of the tube. Inspections are conducted by removing the cap and any exposed insulation. However, the tube frequently falls out after the cap is removed, especially when installed in corrugated metal jackets.

SUMMARY OF THE INVENTION

The present invention is an inspection port that is self-locking and self-sealing when inserted in smooth, embossed, or corrugated metal jackets which contain an insulation layer around process equipment such as reactors, heat exchangers, distillation towers, storage tanks, and pipelines. The inspection port is made from an elastomeric material and includes a tubular body having an outer flange and two locking ridges which are positioned to form a short section for gripping non-corrugated metal and a long section for gripping corrugated metal. The inspection port can be used with a metal or elastomeric polymer cap which is securely attached to the inspection port. An optional extension tube can be inserted into the inspection port to retain insulation.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
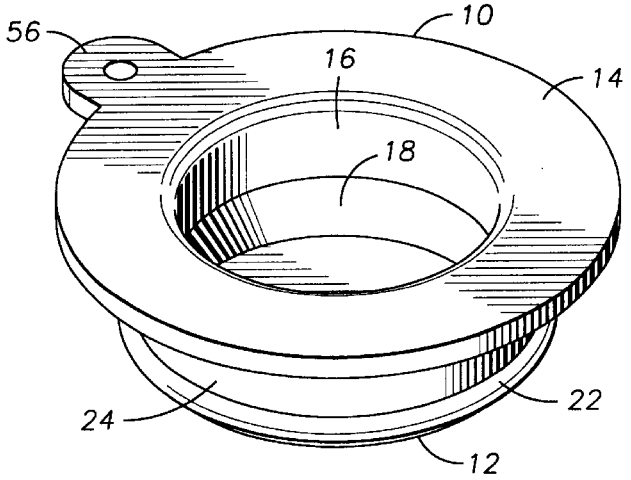
FIGS. 1 and 2 are isometric and side views of an inspection port of the present invention showing a tubular body having an outer flange formed on one end, the tubular body having two locking ridges on a cylindrical outer surface of the tubular body.
Figure 2:
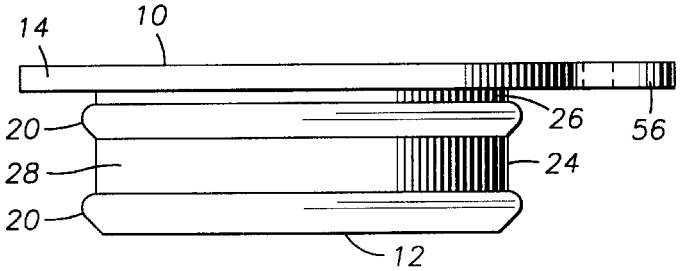
Figure 3:
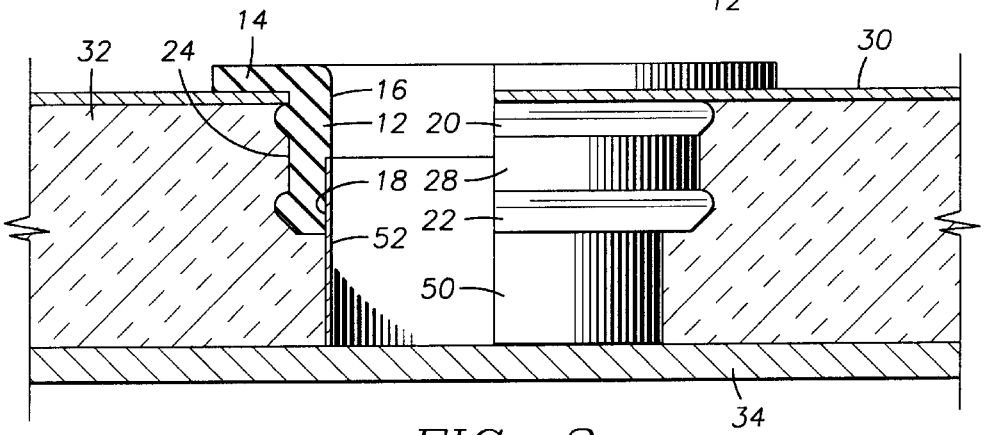
FIG. 3 shows the inspection port of FIGS. 1 and 2 and an optional extension tube inserted into a non-corrugated metal jacket containing an insulation material around a surface to be inspected.
Figure 4:
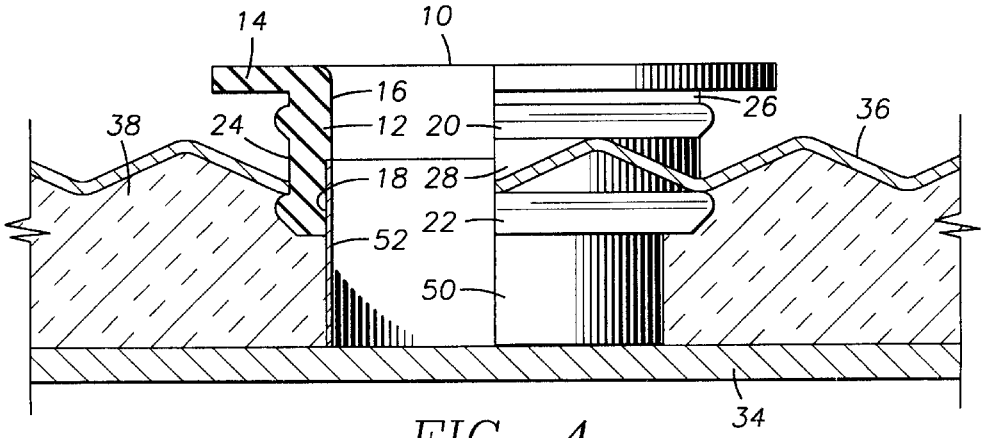
FIG. 4 shows the inspection port of FIGS. 1 and 2 and an optional extension tube inserted into a corrugated metal jacket containing an insulation material around a surface to be inspected.
Figure 6:
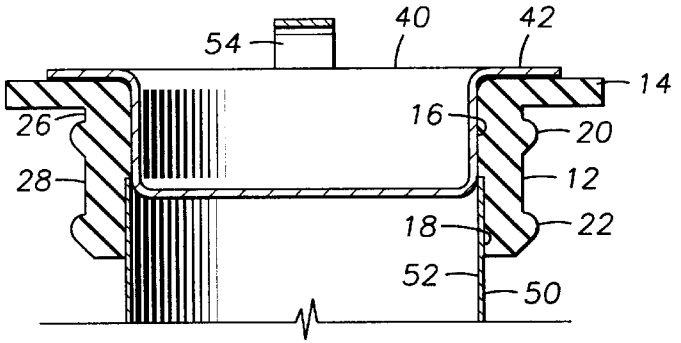
FIGS. 5 and 6 show isometric and sectional views of the inspection port of FIGS. 1 and 2 along with a metal cap inserted into the tubular body and securely attached to the outer flange of the tubular body.
Figure 8:
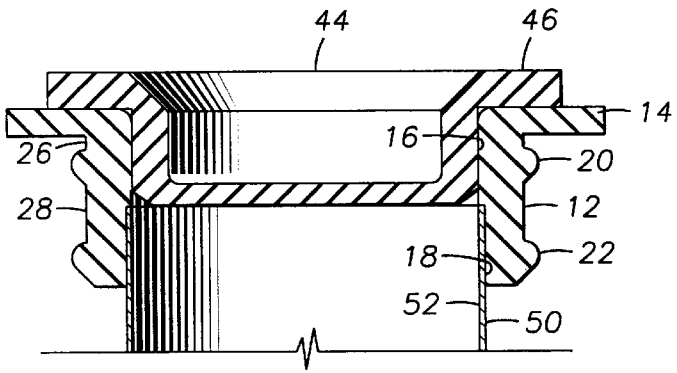
FIGS. 7 and 8 show isometric and sectional views of the inspection port of FIGS. 1 and 2 along with an elastomeric cap inserted into the tubular body and securely attached to the outer flange of the tubular body.

The invention is a self-locking, self-sealing inspection port for insertion into a hole in a metal jacket which contains an insulation material next to a surface to be inspected using non-destructive test methods such as ultrasound. The surface can be a wall of a reactor, heat exchanger, distillation tower, storage tank, pipeline, or other unit having an insulation layer. The inspection port is self-sealing because it is made from an elastomeric polymer and is sized to fit snugly into a hole in the metal jacket. The inspection port can be cylindrical or rectangular, preferably cylindrical. The inspection port is self-locking because it has at least two locking ridges formed on an outer surface for holding the port in the hole in the metal jacket.

Referring to a preferred embodiment shown in FIGS. 1–8, an inspection port 10 has a tubular body 12 and an outer flange 14 both preferably formed of an elastomeric polymer having excellent resistance to low and high temperatures such as a silicone rubber or a terpolymer of ethylene, propylene, and diene monomers (EPDM). The tubular body 12 has a first inner cylindrical surface 16 and a second inner cylindrical surface 18. The tubular body 12 further has a first locking ridge 20 and a second locking ridge 22 formed of the elastomeric polymer on the outer surface 24 of the tubular member 12. The locking ridges 20 and 22 divide the outer surface 24 of the tubular member 12 into a short cylindrical section 26 and a long cylindrical section 28. The short cylindrical section 26 has a length corresponding to the thickness of a smooth metal jacket 30 for containing an insulation layer 32 next to a wall to be inspected 34 and the long cylindrical section 28 has a length corresponding to the apparent thickness of a corrugated metal jacket 36 for containing an insulation layer 38 next to a wall to be inspected 34.

The inspection port 10 is designed for use without additional mechanical or chemical fasteners or sealants, although such materials can be used if desired. Inspection ports have been made as shown in the drawings from a silicone rubber having a temperature resistance from minus 130° F. to 500° F. and from an EPDM polymer having a temperature resistance from minus 67° F. to 340° F. The EPDM rubber has significantly higher tensile strength and elongation than the silicone rubber and both have excellent UV and ozone resistance.

Figure 5:
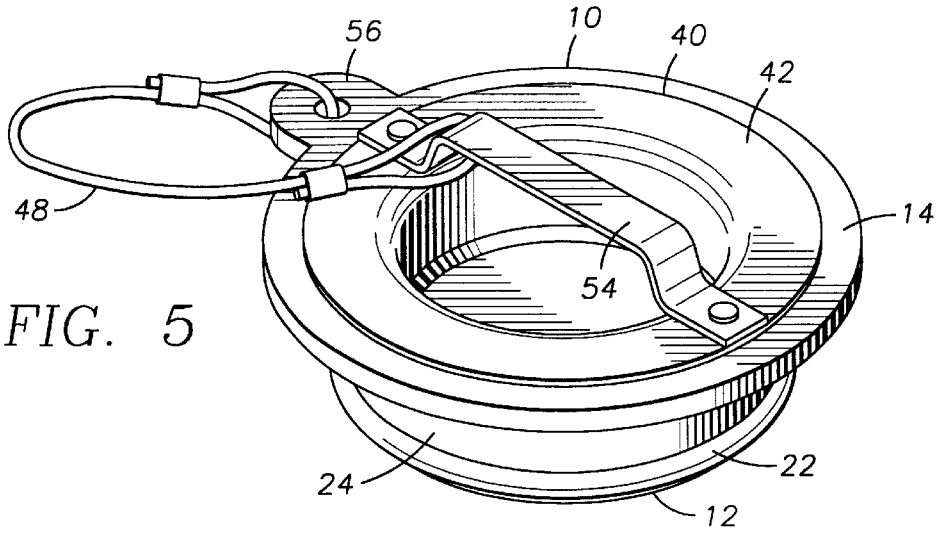
Figure 7:
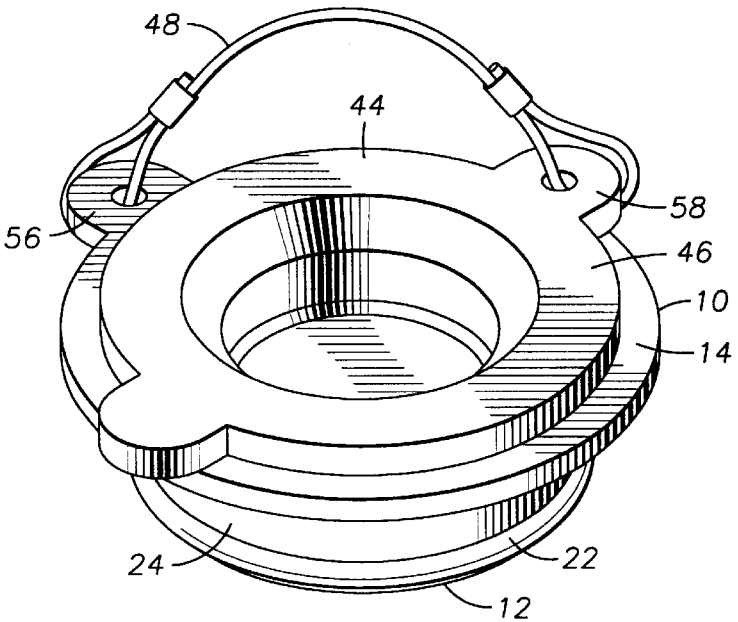

The inspection port 10 can be used with a metal cap 40 having an outer flange 42 or a polymer cap 44 having an outer flange 46. The metal cap 40 or polymer cap 44 fit snugly into the first inner cylindrical surface 16 of the tubular body 12. The caps 40 and 44 are attached to the outer flange 14 of the tubular body 12 by a lanyard 48 as shown in FIGS. 5 and 7, respectively. The lanyard 48 is preferably a braided or twisted cable of small diameter, stainless steel wires. The metal cap 40 or polymer cap 44 fit snugly to form a water-tight seal but are not oversized to expand the tubular body 12.

The inspection port 10 has the second inner cylindrical surface 18 in the tubular body 12 for receiving an optional metal extension tube 50. The second cylindrical inner surface 18 has a larger diameter than the first cylindrical inner surface 16 so that the extension tube 50 will have an inside surface 52 that is flush with the first cylindrical inner surface 16 to limit insertion of the extension tube 50. The extension tube 50 extends into the insulation material 32 or 38 as far as the wall to be inspected 34 or any desired distance. The extension tube 50 keeps the insulation material in place if the insulation is not a solid layer. Insulation material may be placed inside the extension tube 50 when the inspection port 10 is capped and may be any suitable insulation material, preferably a cylinder of a solid material. The extension tube 50 thus isolates the test operator from the insulation material 32 or 38 below the metal jacket 30 or 36.

The metal cap 40 includes a handle 54 formed of bent metal and attached to the outer flange 52 by mechanical means, which may include but are not limited to, riveting or resistance welding. The lanyard 48 is looped around the handle 54 and through a tab 56 on the outer flange 14 of the inspection port 10. For the polymer cap 44, the lanyard 48 is looped through a tab 58 on the outer flange 46 of the polymer cap 44 and the tab 56 on the outer flange 14 of the inspection port 10.

The inspection port 10 is readily installed by drilling a hole in a non-corrugated metal jacket 30 or a corrugated metal jacket 36 and removing the underlying insulation material 32 or 38. The inspection port 10 is then inserted to position a non-corrugated jacket 30 between the outer flange 14 and the first locking ridge 20 or to position a corrugated jacket 36 between the first locking ridge 20 and the second locking ridge 22. When used, the extension tube 50 must be inserted into the tubular body 12 prior to insertion of the inspection port 10 in the metal jacket 30 or 36. The inspection port 10 can be inserted with or without the cap 40 or 44 in place and is most conveniently inserted with the cap removed. Inspections are readily conducted by removing the cap 40 or 44 and any insulation material placed back in the hole in the jacket or within the extension tube 50. The lanyard 48 prevents loss of the cap 40 or 44 prior to re-insertion after inspection.

The invention has been described by reference to specific embodiments which teach and support a broader concept of the invention as defined by the following claims.

While the foregoing is directed to the preferred embodiment of the present invention, other and further embodiments of the invention may be devised without departing from the basic scope thereof, and the scope thereof is determined by the claims which follow.

We claim:

1. An inspection port for insertion into a hole in a jacket, comprising:

(a) an elastomeric tubular body having an outer surface;

(b) an outer flange formed on one end of the tubular body; and (c) at least two locking ridges formed on the outer surface of the tubular body, the ridges dividing the outer surface into at least one short section located between said outer flange and an adjacent locking ridge and having length corresponding to a thickness of a smooth jacket, and at least one long section located between two of said locking ridges and having a length chosen to correspond to an apparent thickness of a corrugated jacket.

2. The inspection port of claim 1, wherein the tubular body has a cylindrical outer surface and a first inner cylindrical surface for receiving a cap within the outer flange end of the tubular body and a second inner cylindrical surface for receiving a metal extension tube, wherein the first inner cylindrical surface has a smaller diameter than the second inner cylindrical surface.

3. The inspection port of claim 2, wherein the long section is a cylindrical section having a length corresponding to the apparent thickness of a corrugated jacket containing insulation and the short section is a cylindrical section having a length corresponding to the thickness of a smooth jacket containing insulation.

4. The inspection port of claim 3, further comprising a cap for insertion in the outer flange end of the tubular body and means for attaching the cap to the outer flange of the tubular body.

5. The inspection port of claim 4, wherein the tubular body including the outer flange and the locking ridges are formed from a silicon rubber or an elastomeric terpolymer of ethylene, propylene, and diene monomers.

6. The inspection port of claim 5, wherein the cap is formed from a silicon rubber or an elastomeric terpolymer of ethylene, propylene, and diene monomers.

7. An inspection port, comprising:

(a) an elastomeric tubular body having a cylindrical outer surface;

(b) an outer flange formed on one end of the tubular body, wherein the tubular body has a first inner cylindrical surface for receiving a cap within the outer flange end of the tubular body and a second inner cylindrical surface for receiving a metal extension tube, and wherein the first inner cylindrical surface has a smaller diameter than the second inner cylindrical surface; and (c) at least two locking ridges formed on the cylindrical outer surface of the tubular body, the ridges dividing the cylindrical outer surface into at least one short cylindrical section having a length corresponding to the thickness of a smooth jacket and at least one long cylindrical section having a length corresponding to the apparent thickness of a corrugated jacket; and (d) an extension tube having an end inserted into the tubular body at the second inner cylindrical surface of the tubular body.

8. The inspection port of claim 7, wherein the tubular body has a first inner cylindrical surface for receiving a cap within the outer flange end of the tubular body and a second inner cylindrical surface for receiving a metal extension tube, wherein the first inner cylindrical surface has a smaller diameter than the second inner cylindrical surface.

9. The inspection port of claim 8, further comprising an extension tube having an end inserted into the tubular body at the second inner cylindrical surface of the tubular body.

10. The inspection port of claim 9, further comprising a cap for insertion in the outer flange end of the tubular body and a lanyard for attaching the cap to the outer flange of the tubular body.

11. The inspection port of claim 10, wherein the tubular body including the outer flange and the locking ridges are formed from a silicon rubber or an elastomeric terpolymer of ethylene, propylene, and diene monomers.

12. The inspection port of claim 11, wherein the cap is formed from a silicon rubber or an elastomeric terpolymer of ethylene, propylene, and diene monomers.

13. An inspection port for insertion into a hole in a jacket, comprising:

(a) an elastomeric tubular body having a cylindrical outer surface;

(b) an outer flange formed on one end of the tubular body; and (c) two locking ridges formed on the cylindrical outer surface of the tubular body, the ridges dividing the cylindrical outer surface into a short cylindrical section located between said outer flange and an adjacent locking ridge and having a length chosen to correspond to the thickness of a smooth jacket and a long cylindrical section located between said two locking ridges and having a length chosen to correspond to the apparent thickness of a corrugated jacket.

14. The inspection port of claim 13, wherein the tubular body has a first inner cylindrical surface for receiving a cap within the outer flange end of the tubular body and a second inner cylindrical surface for receiving a metal extension tube, wherein the first inner cylindrical surface has a smaller diameter than the second inner cylindrical surface.

15. The inspection port of claim 14, further comprising a metal extension tube having an end inserted into the tubular body at the second inner cylindrical surface of the tubular body.

16. The inspection port of claim 15, further comprising a cap for insertion in the outer flange end of the tubular body and a lanyard attaching the cap to the outer flange of the tubular body.

17. The inspection port of claim 16, wherein the tubular body including the outer flange and the locking ridges are formed from a silicon rubber or an elastomeric terpolymer of ethylene, propylene, and diene monomers.

18. The inspection port of claim 17, wherein the cap is formed from a silicon rubber or an elastomeric terpolymer of ethylene, propylene, and diene monomers.

* * * * *